US005386983A

United States Patent [19]

Ando

[11] Patent Number: 5,386,983

[45] Date of Patent: Feb. 7, 1995

[54] SHEET FEEDING APPARATUS WITH REDUCED GENERATION OF STATIC ELECTRICITY

[75] Inventor: Masao Ando, Yokohama, Japan

[73] Assignee: Canon Kabushiki Kaisha, Tokyo, Japan

[21] Appl. No.: 44,081

[22] Filed: Apr. 6, 1993

Related U.S. Application Data

[63] Continuation of Ser. No. 728,286, Jul. 11, 1991, abandoned.

[30] Foreign Application Priority Data

Jul. 13, 1990 [JP] Japan ..... 2-185622

[51] Int. Cl.[6] ..... B65H 3/06

[52] U.S. Cl. ..... 271/118; 271/124; 271/127; 271/251

[58] Field of Search ..... 271/117, 118, 121, 124, 271/126, 127, 171, 251, 10

[56] References Cited

U.S. PATENT DOCUMENTS

| | | | |
|---|---|---|---|
| 2,363,357 | 11/1944 | Post | 271/39 |
| 4,113,245 | 9/1978 | Colglazier et al. | 271/121 |
| 4,312,503 | 1/1982 | Saxinger et al. | 271/124 |
| 4,535,981 | 8/1985 | Watanabe et al. | 271/124 |
| 4,572,498 | 2/1986 | Shiozawa | 271/121 |
| 4,676,498 | 6/1987 | Kanemitsu et al. | 271/251 |
| 4,717,139 | 1/1988 | Sootome et al. | 271/118 |
| 4,809,968 | 3/1989 | Malachowski | 271/251 |
| 4,978,115 | 12/1990 | Sato et al. | 271/124 |
| 5,052,678 | 10/1991 | Looney | 271/251 |
| 5,056,604 | 10/1991 | Garavuso | 271/124 |
| 5,065,998 | 11/1991 | Salamon | 271/251 |
| 5,181,712 | 1/1993 | Perino | 271/124 |

FOREIGN PATENT DOCUMENTS

| | | | |
|---|---|---|---|
| 2283842 | 4/1976 | France . | |
| 135039 | 10/1980 | Japan | 271/124 |
| 82251 | 4/1988 | Japan | 271/121 |
| 196432 | 8/1988 | Japan | 271/121 |
| 104537 | 4/1989 | Japan | 271/121 |
| 281233 | 11/1989 | Japan | 271/121 |
| 0294126 | 11/1989 | Japan | 271/121 |
| 0038230 | 2/1990 | Japan | 271/121 |
| 2138041 | 5/1990 | Japan . | |
| 2195614 | 4/1988 | United Kingdom . | |

OTHER PUBLICATIONS

Patent Abstracts of Japan, vol. 14, No. 375 (M-1010) [4318] Aug. 14, 1990 Abstract of Japanese Patent Document No. 2-138041, published May 28, 1990.

Patent Abstracts of Japan, vol. 12, No. 374 (M-749) [3221] Oct. 6, 1988, Abstract of Japanese Patent Document No. 63-123729, published May 27, 1988.

Patent Abstracts of Japan, vol. 11, No. 74 (M-568) [2521] Mar. 6, 1987, Abstract of Japanese Patent Document No. 61-229735, published Oct. 14, 1986.

Patent Abstracts of Japan, vol. 10, No. 181 (M-492) [2237] Jun. 25, 1986, Abstract of Japanese Patent Document 61-27840, published Feb. 7, 1986.

Patent Abstracts of Japan, vol. 9, No. 128 (M-384) [1851] Jun. 4, 1985, Abstract of Japanese Patent Document No. 60-12426, published Jan. 22, 1985.

Patent Abstracts of Japan, vol. 8, No. 143 (M-306) [1580] Jul. 4, 1984, Abstract of Japanese Patent Document No. 59-39641, published Mar. 5, 1984.

*Primary Examiner*—H. Grant Skaggs
*Assistant Examiner*—Carol L. Druzbick
*Attorney, Agent, or Firm*—Fitzpatrick, Cella, Harper & Scinto

[57] ABSTRACT

A sheet feeding apparatus having a sheet support for supporting sheets, a rotatable sheet supply roller for feeding out the sheets supported by the sheet support, a first biasing mechanism for biasing the sheet support to generate pressure between the sheets and the rotatable sheet supply roller, a separating device for separating the sheets between the separating device and the rotatable sheet supply roller, a second biasing mechanism for biasing the separating device to generate pressure between the separating device and the rotatable sheet supply roller and a pressure releasing mechanism for releasing the pressures generated by the first and second biasing mechanisms after the sheets are separated by the separating device. The present invention further provides an image forming system with the above-mentioned sheet feeding apparatus and an image forming mechanism for forming an image on the sheet separated by the separating device.

43 Claims, 12 Drawing Sheets

FIG. 7A
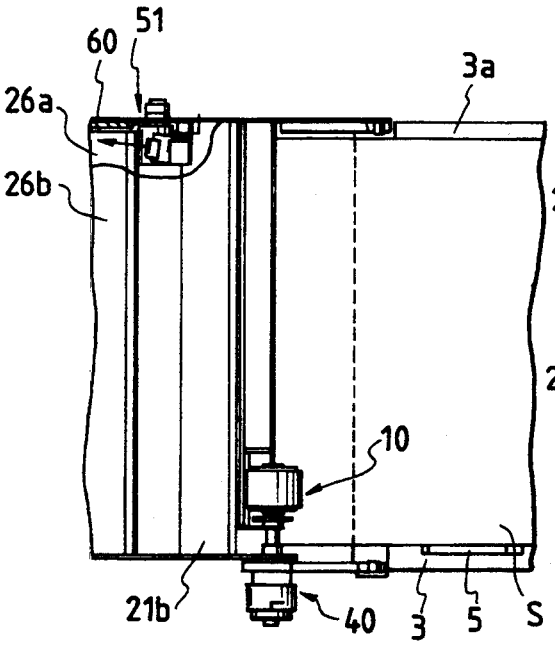
FIG. 7B
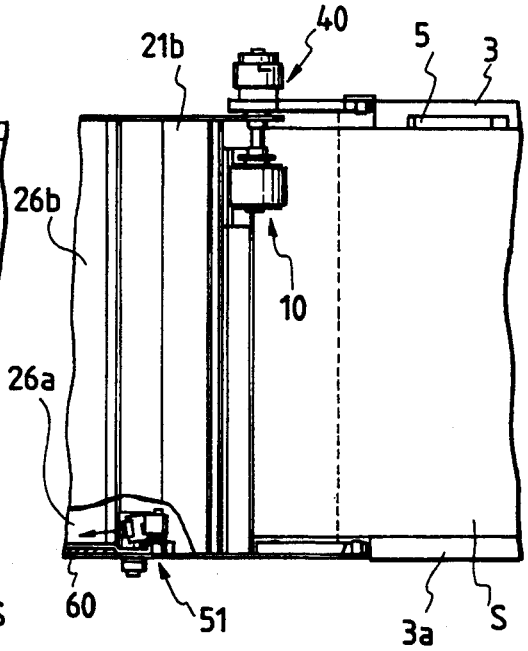
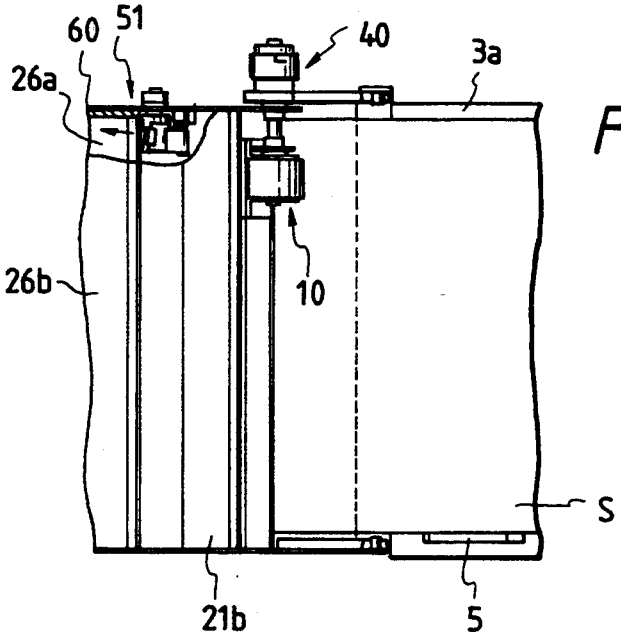
FIG. 7C

SHEET FEEDING APPARATUS WITH REDUCED GENERATION OF STATIC ELECTRICITY

This application is a continuation, of application Ser. No. 07/728,286 filed Jul. 11, 1991, now abandoned.

BACKGROUND OF THE INVENTION

1. Field of the Invention

The present invention relates to a sheet feeding apparatus which is incorporated into an image forming system such as a copying machine, laser beam printer, facsimile and the like.

2. Related Background Art

Conventionally, as one of sheet feeding apparatuses incorporated into a sheet supplying portion of a printer, a sheet feeding apparatus having an arrangement, for example, as shown in FIGS. 11 and 12 has been known.

In FIGS. 11 and 12, a sheet supply roller 10 comprising a metal core 12 integrally formed with a support shaft 11 and a friction member 13 covering an outer peripheral surface of the metal core is disposed at a downstream side of a sheet stacking support 3 on which a plurality of sheets S are stacked. A separating pad 17 formed on a free end of a pivotable support member 81 is urged against the sheet supply roller 10 by a spring force of a separating spring 20.

Further, the sheet S is urged against the sheet supply roller 10 by means of a pressurizing means comprising an intermediate plate 7 attached to a support plate 80 and a pressure spring 9. On one end of the support shaft 11, there are arranged a cam 33, a gear 35 drivingly connected to a drive source (not shown), and a spring clutch 40. The spring clutch 40 comprises a control ring 36, a boss 37 and a spring (not shown), and one revolution of the spring clutch 40 is controlled by a solenoid 41.

A pair of feed rollers 83 comprising a drive roller and a driven roller urged against the drive roller are arranged within a body frame of the apparatus. Gears 30*a*, 30*b* and adapted to transmit a driving force and are integrally formed with the drive and driven rollers, respectively, to be meshed with each other.

When the solenoid 41 is turned ON, the engagement between a control pawl 41*a* of the solenoid 41 and a pawl 36*a* of the control ring 36 is released, thereby activating the spring clutch 40, with the result that a driving force of the gear 35 is transmitted to the support shaft 11 to rotate the sheet supply roller 10. Further, by the rotation of the cam 33, the regulation of a free end 6*b* of the support plate 6 is also released, with the result that the intermediate plate 7 is lifted by the pressure spring 9 to urge an uppermost sheet on the stacked sheets S (sheet stack) against the sheet supply roller 10, thus feeding out the sheet. When the sheet supply roller 10 is rotated by one revolution, the pawl 36*a* of the control ring 36 is engaged by the control pawl 41*a* of the solenoid 41 which is now in an OFF condition, thereby releasing the spring clutch 40 to stop the sheet supply roller 10. At the same time, the support plate 6 is forcibly lowered by the cam 33, with the result that the intermediate plate 7 is stopped and maintained in a lowered position. The sheet S separated by the separating pad 17 is conveyed by the paired rollers 83 while being guided by guide plates 21*a*, 21*b*.

However, in the above-mentioned conventional arrangement, the following problems arise.

Since the separating pad 17 and the sheet S are always urged against the sheet supply roller 10, even during the sheet supplying operation, static electricity is generated due to the sliding contact between the sheets S and is accumulated on the surface of the sheet, thus causing the poor transfer of toner to the sheet to worsen the image quality.

Further, as shown in FIG. 13, the pressure between the drive roller 23 and the driven roller 25 of the paired feed rollers 83 is not uniform, the pressures F at both end portions being stronger than the pressure f at an intermediate portion due to the flexion of the rollers. Accordingly, the pinching force between the rollers is also stronger at the both end portions than at the intermediate portion. Consequently, in the case of a sheet feeding apparatus of frictional separating type, unless a friction separating means is arranged at a central position with respect to a width of the sheet S, the sheet conveying force is unbalanced due to the back tension generated by the sheet supply roller 10, separating pad 17 and the sheet stacking support 3 during the sheet supplying operation, thereby easily causing the skew-feed of the sheet S. In particular, when the sheet supply roller 10 is constituted by a round or cylindrical roller, such back tension will be increased.

Further, as shown in FIGS. 14 and 15, in the case where a universal tray is used for stacking sheets S having different sizes, since a separating and supplying portion must be always arranged at a central position with respect to a width of the sheet S (referred to as "center reference" hereinafter), the spring force of the tension spring 29 for the paired feed rollers 83 must be selected with higher accuracy. Furthermore, in the center reference, since regulating plates 85*a*, 85*b* for regulating the transverse position of the sheets S stacked on the stacking means must be shifted symmetrically with respect to the center of the sheet S, the number of parts of the apparatus is increased, thus making the apparatus expensive and worsening the accuracy of the positioning of the sheets in the transverse direction.

Further, as shown in FIG. 12, when the sheet feeding apparatus 1 is replaced by another one, since the sheet supply roller 10 is disposed at the center of the sheet, it is difficult to maintain a space required for exchanging the sheet supply roller 10.

SUMMARY OF THE INVENTION

An object of the present invention is to prevent the poor formation of an image due to the static electricity on the sheet supplied by a separating means and a sheet supply means while being pinched therebetween, and to prevent the skew-feed of the sheet due to a back tension.

In order to achieve the above object, the present invention provides a sheet feeding apparatus comprising a sheet containing means for supporting sheets, a rotatable sheet supply means for feeding out the sheet supported by the sheet containing means, a separating means for separating the sheets one by one between the separating means and the rotatable sheet supply means by abutting against the sheet fed out by the rotatable sheet supply means, and a pressure releasing means for releasing an urging pressure of the separating means on the way to separate and feed the sheet by means of the separating means.

With this arrangement, since the urging pressure is released on the way to separate and feed the sheet by means of the separating means, the occurrence of the static electricity is reduced. Further, since the back tension can also be decreased, the occurrence of the skew-feed of the sheet is reduced.

Incidentally, a displacing means for shifting the sheet containing means and the rotatable sheet supply means between a sheet supplying position where they are urged against each other and a waiting position where they are separated from each other may be provided, and the pressure releasing means may release the urging pressure in response to the separating operation for separating the sheet containing means and the rotatable sheet supply means from each other.

Further, according to more concrete construction, the sheet containing means may comprise an intermediate plate adapted to support the sheets thereon and shiftable between the sheet supplying position and the waiting position and a biasing means for biasing the intermediate plate toward the sheet supplying position, and the displacing means may comprise a cam having a cam portion for shifting the intermediate plate from the sheet supplying position to the waiting position in opposition to the biasing force of the biasing means and a cam portion for shifting the intermediate plate from the waiting position to the sheet supplying position.

In addition, the rotatable sheet supply means may comprise a sheet supply roller mounted on a drive shaft, and the cam may be provided on the drive shaft, so that the cam shifts the intermediate plate between the sheet supplying position and the waiting position once whenever the sheet supply roller is rotated by one revolution.

The separating means may comprise a friction pad which can be urged against and separated from the rotatable sheet supply means and which is urged against the rotatable sheet supply means by means of the biasing means. As the intermediate plate is shifted from the sheet supply position to the waiting position, the intermediate plate is engaged by friction pad. Thereafter, in response to the separating operation for separating the sheet containing means and the sheet supply means from each other, the friction pad is separated from the sheet supply means in opposition to the elastic force of the elastic means, thus releasing the urging pressure. In this way, by adopting the arrangement wherein the friction pad is urged against the rotatable sheet supply means for feeding out the sheets supported by the intermediate plate, it is possible to arrange the friction pad in the proximity of the intermediate plate, thus simplifying the construction of the engagement means for releasing the urging pressure.

Another object of the present invention is to make the apparatus inexpensive and to facilitate the replacement or exchange of the sheet supply roller.

In order to achieve this object, the present invention provides a sheet feeding apparatus comprising a sheet containing means for supporting sheets, a rotatable sheet supply means disposed at a position offset from a center line of a width of the sheet supported by the sheet containing means toward one end of the sheet and adapted to feed out the sheet supported by the sheet containing means, a separating means for separating the sheets one by one between the separating means and the rotatable sheet supply means by abutting against the rotatable sheet supply means, and a pressure releasing means for releasing an urging pressure of the separating means on the way to separate and feed the sheet by means of the separating means.

With this arrangement, since the rotatable sheet supply means is disposed offset from the center line of the sheet, it is possible to obtain a space required for replacing the rotatable sheet supply means, thus facilitating the replacing operation.

Further, since the sheet can be supplied on the basis of a one side reference rather than the center reference, only one of the regulating members for regulating the transverse position of the sheet can be shiftable, thus simplifying the construction of the apparatus to make the apparatus inexpensive.

BRIEF DESCRIPTION OF THE DRAWINGS

FIGS. 7A to 7C are plan views of a sheet feeding apparatus according to a fourth embodiment of the present invention;

DETAILED DESCRIPTION OF THE PREFERRED EMBODIMENTS

Figure 11:
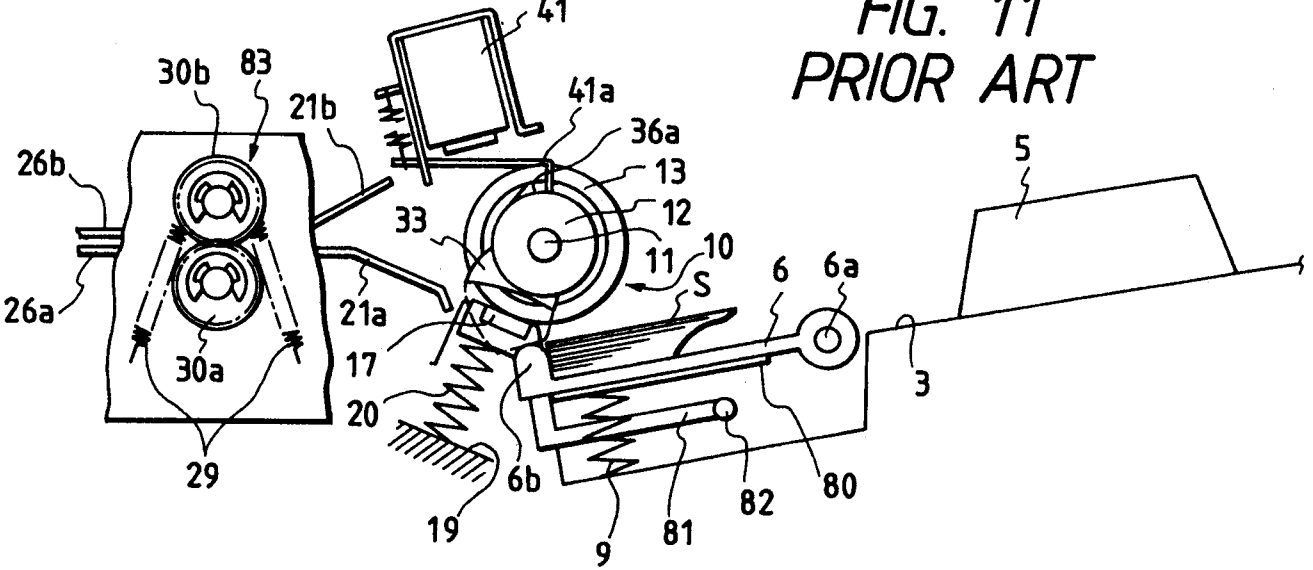
FIG. 11 PRIOR ART
FIG. 11 is an elevational sectional view of a conventional sheet feeding apparatus.
Figure 13:
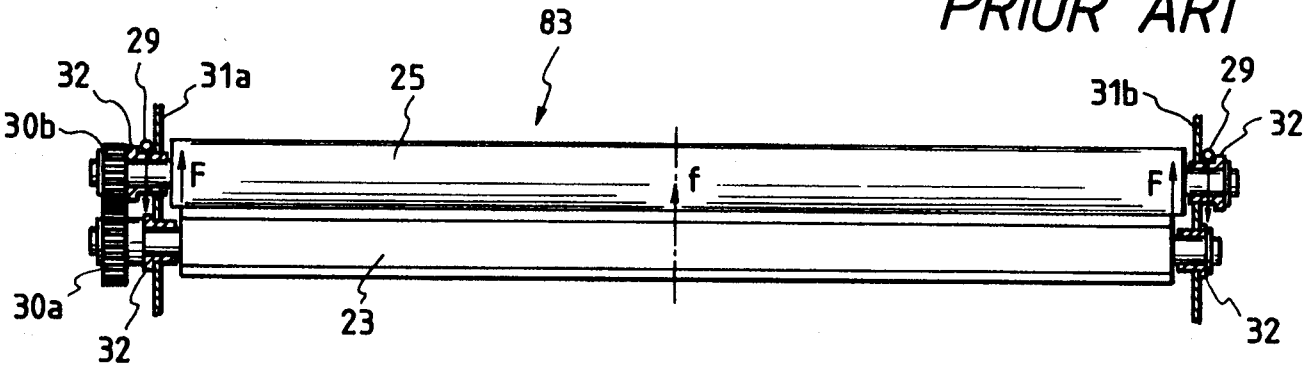
FIG. 13 PRIOR ART
FIG. 13 is an elevational view of feed rollers of the apparatus of FIG. 11.
Figure 12:
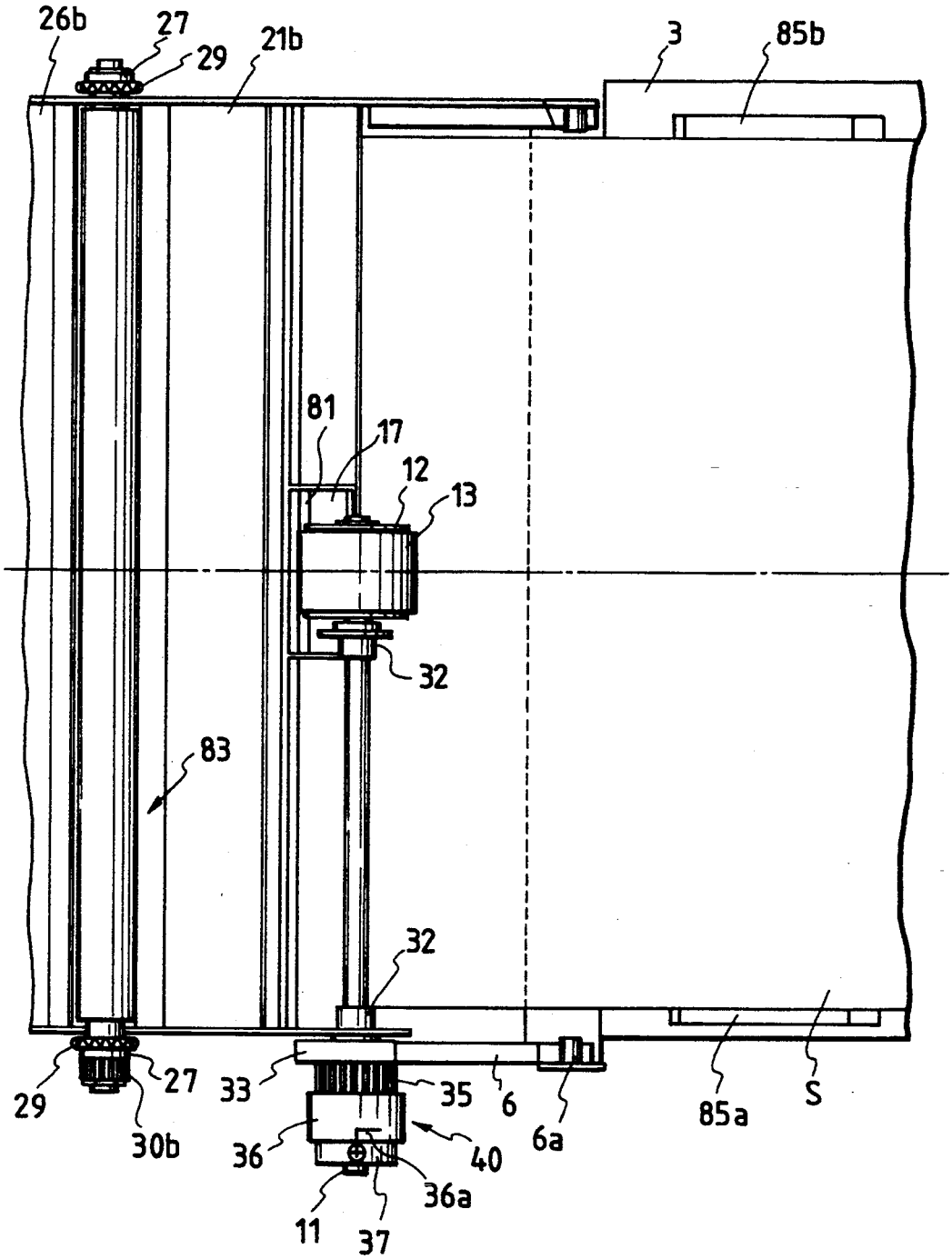
FIG. 12 PRIOR ART
FIG. 12 is a plan view of the apparatus of FIG. 11.
Figure 14:
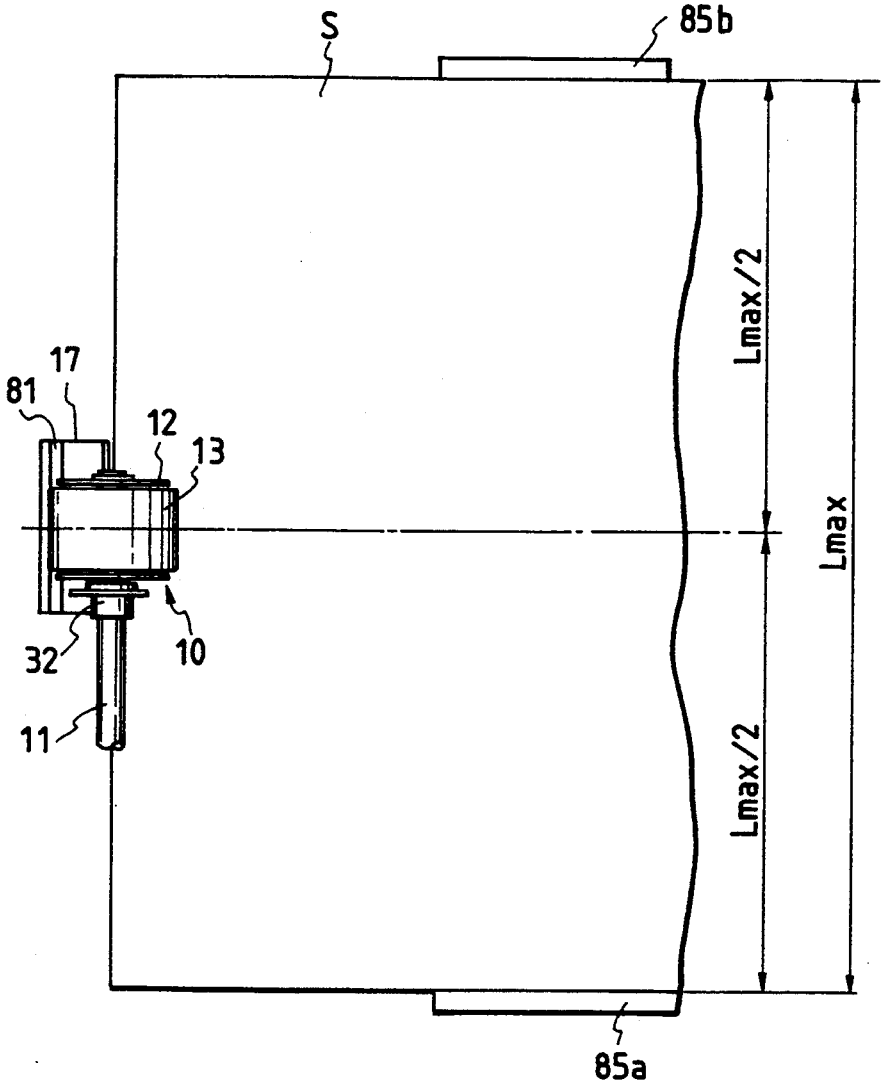
FIG. 14 PRIOR ART
FIGS. 14 and 15 are plan views of sheets to be supplied.
Figure 15:
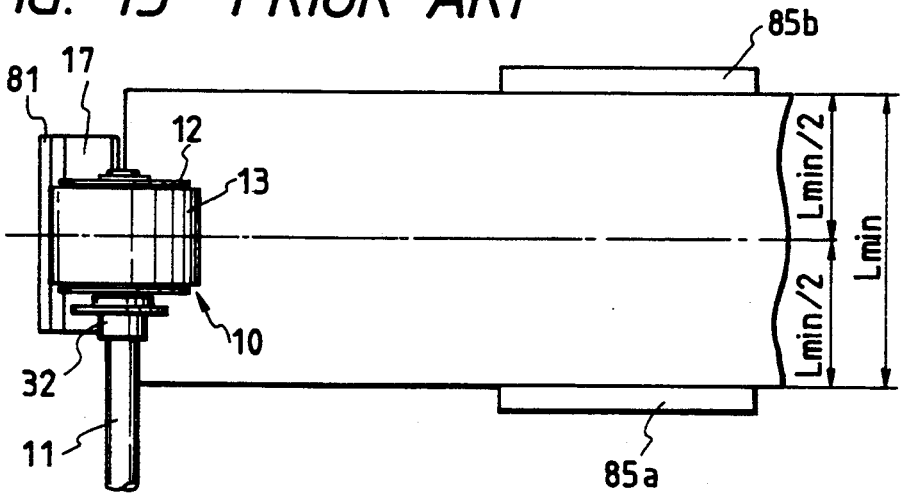
FIG. 15 PRIOR ART

The present invention will now be explained in connection with a preferred embodiment thereof with reference to FIGS. 1 to 3. Incidentally, the parts or elements same as those shown in FIGS. 11 and 12 are designated by the same reference numerals and the explanation thereof will be omitted.

Figure 1:
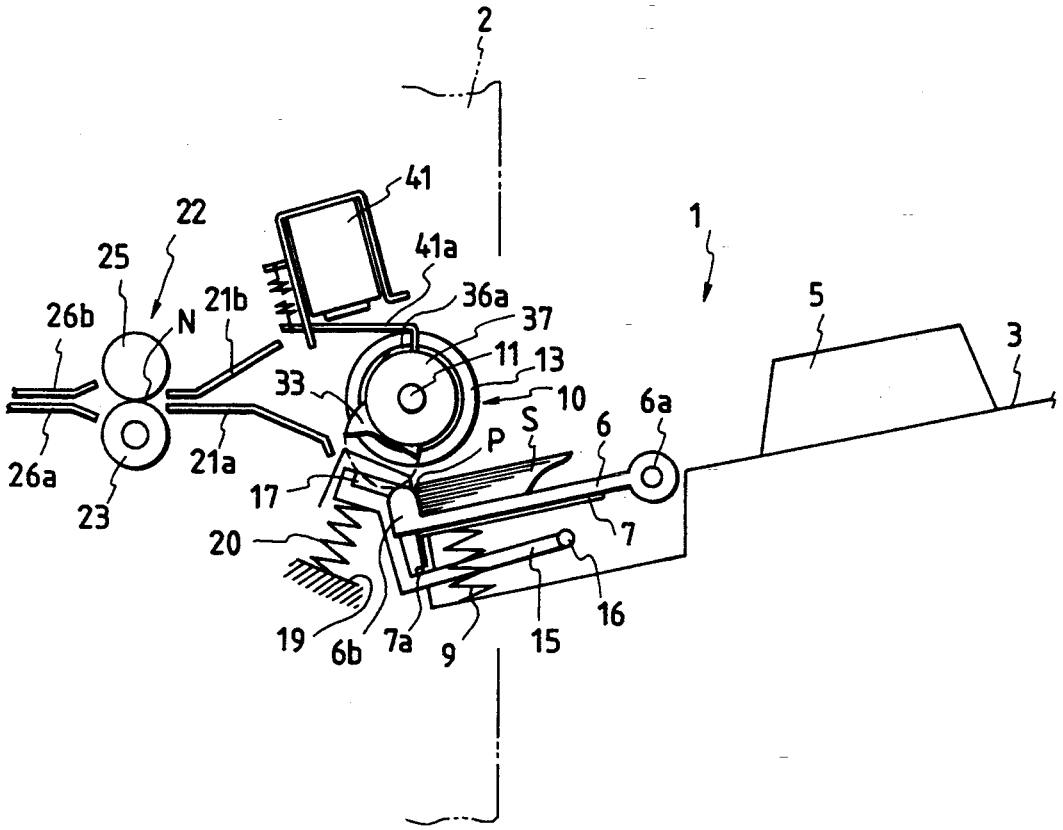
FIG. 1 is an elevational sectional view of a sheet feeding apparatus according to a preferred embodiment of the present invention.
Figure 2:
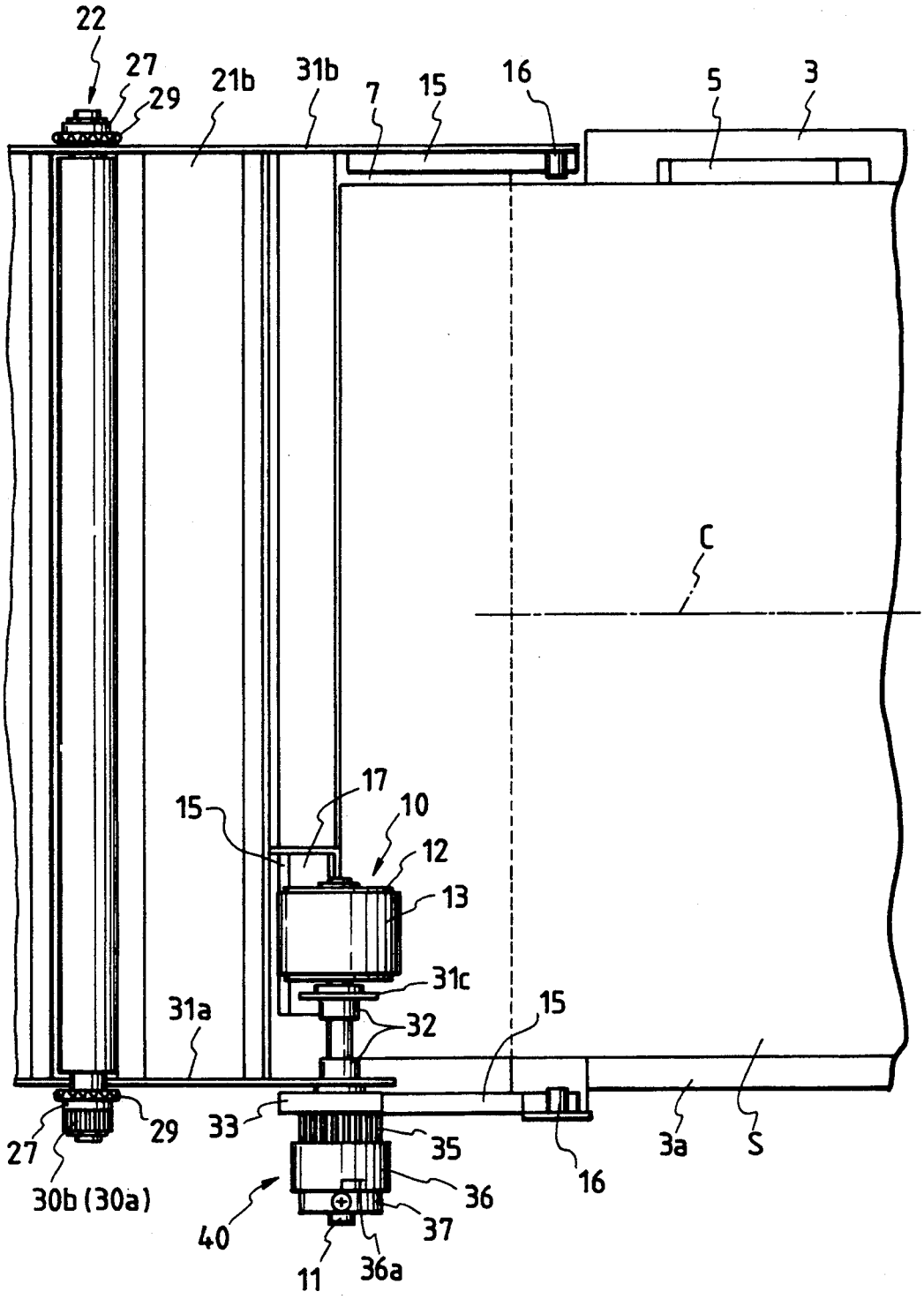
FIG. 2 is a plan view of the apparatus of FIG. 1.

In FIGS. 1 to 3, front parts of sheets S stacked on a sheet stacking support 3 are supported by an intermediate plate 7 for up-and-down movement, and a support member 6 to which the intermediate plate 7 is fixed is pivotally mounted on the sheet stacking support 3 via a support shaft 6*a*. The intermediate plate (stacking means) 7 is biased upwardly by means of a pressure spring (pressurizing means) 9. A support member 15 on a free end of which a separating pad 17 is formed is pivotally mounted on a support shaft 16.

A releasing member 7*a* is integrally formed on a free end of the intermediate plate 7, and a lower end of the releasing member 7*a* is opposed to the support member 15. Thus, when the support member 6 is lowered by rotation of a cam 33, the releasing member 7a is abutted against the support member 15, thereby lowering the latter.

At a downstream side of the separating pad 17, a pair of feed rollers 22 comprising a drive roller 23 and a driven roller 25 urged against the drive roller are disposed. A pair of guides 21a, 21b and a pair of guides 26a, 26b are disposed at left and right sides of the paired feed rollers 22, respectively.

As shown in FIG. 2, a support shaft 11 is rotatably supported, via bearings 32, by a side plate 31a of the sheet feeding apparatus and by a support plate 31c arranged near the side plate 31a. A sheet supply roller 10 supported by the support shaft 11 is offset from a center line of the sheet stacking support 3.

Further, the pressure spring 9 and the separating pad 17 are also offset from a center line C of the sheet S (extending in a longitudinal direction of the sheet) toward one lateral edge (left edge in the illustrated embodiment) of the sheet, so that the sheet can be supplied even when a width of the sheet is reduced to some extent. Further, the sheets S stacked on the sheet stacking support 3 are urged laterally by a regulating plate 5 for performing lateral positioning or aligning of the sheets, so that the other lateral edges of the sheets are abutted against an abutment member 3a.

Incidentally, a peripheral speed of the sheet supply roller 10 is selected to be the same as a peripheral speed of the drive roller 23 of the feed roller pair 22. Further, a peripheral length of the sheet supply roller 10 is selected to be longer than a distance (P−N) between a sheet supplying point (leading end of the sheet) and a nip of the feed roller pair 22 but shorter than a longitudinal length of the sheet S.

When the sheets S are stacked on the sheet stacking support 3, as shown in FIG. 1, the separating pad 17 and the intermediate plate 7 are in the lowered positions, and the separating pad 17 and the sheets are in a waiting position where they are not contacted by the sheet supply roller 10.

Next, an operation of the sheet feeding apparatus will be explained with reference to FIGS. 3A and 3B.

Figure 3A:
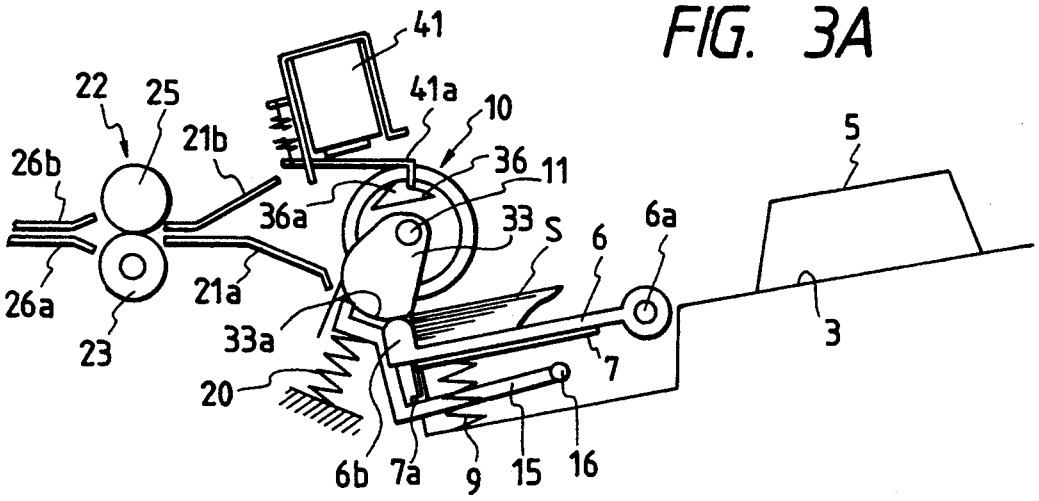
FIGS. 3A to 3C are elevational sectional views showing the operation of the sheet feeding apparatus.

FIG. 3A shows a waiting condition. In this condition, a pawl 36a of a control ring 36 is locked by an actuator or control pawl 41a of a solenoid 41, with the result that, even when a driving force is transmitted to the gear 35 (FIG. 2), the sheet supply roller 10 is stopped and held in the waiting position shown in FIG. 3A under the action of a spring clutch 40. In this case, a sliding portion 33a of the cam 33 is abutted against a free end 6b of the support member 6 so that the intermediate plate 7 is lowered in opposition to the pressure spring 9. Further, the releasing portion 7a of the intermediate plate 7 is abutted against the support member 15 for the separating pad 17 so that the separating pad 17 is lowered in opposition to a separating spring 20.

Figure 3B:
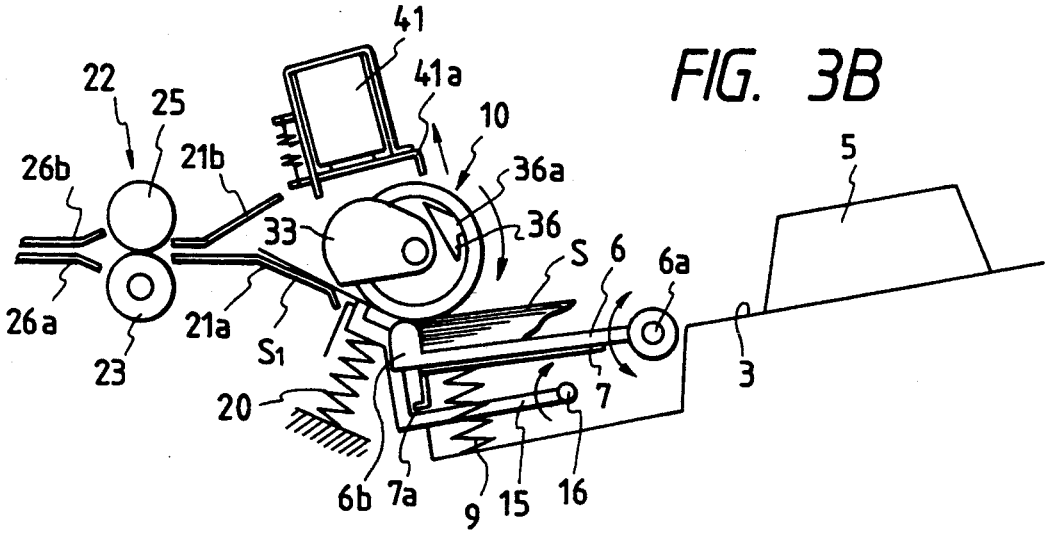

In FIG. 3B, when a current flows in the solenoid 41, the actuator 41a is shifted in a direction shown by the arrow to release the pawl 36a of the control ring 36. Consequently, the driving force is transmitted to the support shaft 11 by the action of the spring clutch 40, thereby rotating the cam 33 and the sheet supply roller 10 in a direction shown by the arrow simultaneously.

As a result, support member 6 is rotated around the support shaft 6a by the sliding portion 33a of the cam 33 in a direction shown by the arrow, with the result that the intermediate plate 7 is lifted by the pressure spring 9, thus urging the sheets S against the sheet supply roller 10. Further, as the intermediate plate 7 is shifted as mentioned above, the support member 15 is also rotated around the support shaft 16 in a direction shown by the arrow, thus urging the separating pad 17 against the sheet supply roller 10. Consequently, an uppermost sheet $S_1$ on the sheet stack S is separated one by one by the separating pad 17 and is fed.

Figure 3C:
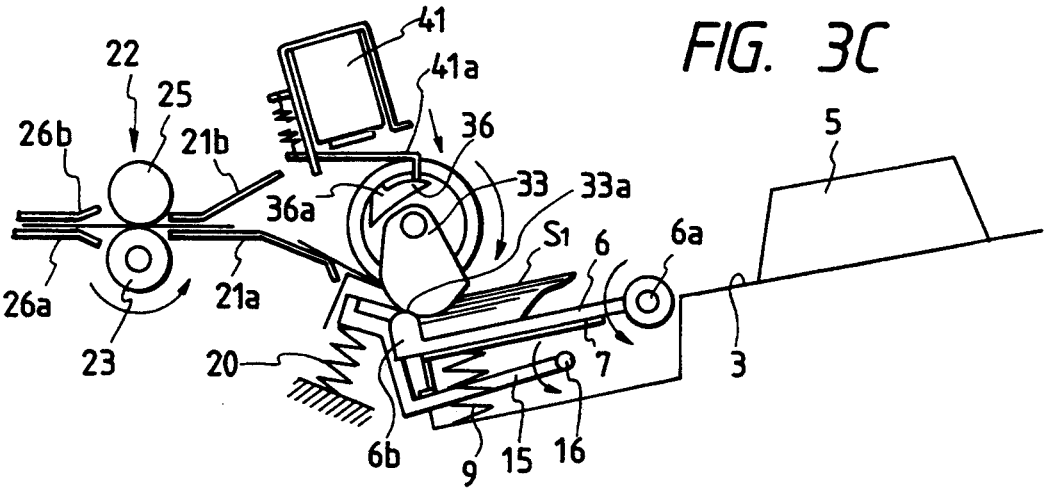

Then, in FIG. 3C, after the sheet supply roller 10 is rotated until the fed sheet $S_1$ is pinched by the paired feed rollers 22 and starts to be conveyed, the support member 6 for the intermediate plate 7 is gradually lowered in a direction shown by the arrow by means of the cam 33, thus rotating the support member 15 and the separating pad 17 in the direction shown by the arrow. That is to say, since a rear portion of the sheet $S_1$ being fed is not urged by the sheet supply roller 10, the sheet $S_1$ is not subjected to a back tension. Thereafter, the pawl 36a of the control ring 36 is locked by the actuator 41a to stop the rotation of the cam 33 and the sheet supply roller 10, thereby returning to the condition shown in FIG. 3A.

Figure 4A:
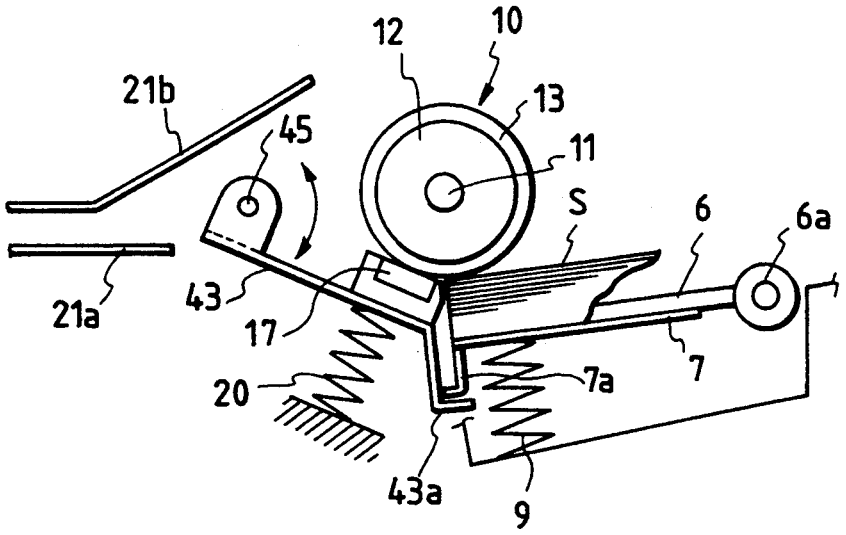
FIGS. 4A and 4B are elevational sectional views of a sheet supply roller portion of a sheet feeding apparatus according to a second embodiment of the present invention.
Figure 4B:
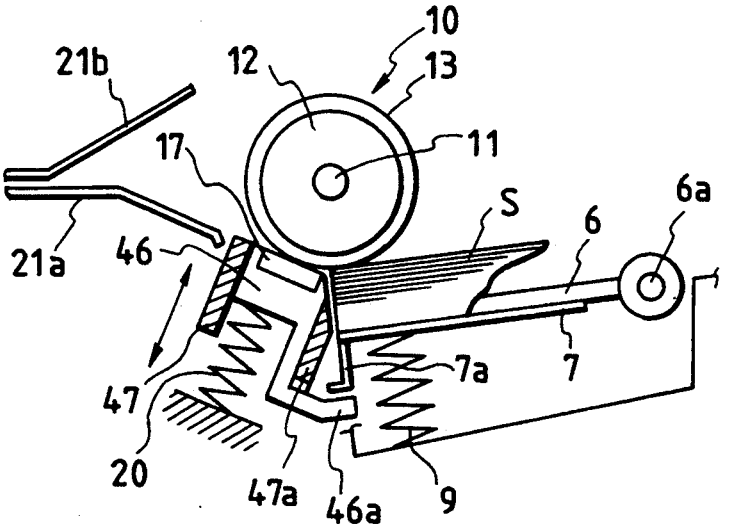

FIGS. 4A and 4B show a second embodiment of the present invention.

As shown in FIG. 4A, a support member 43 holding the separating pad 17 is pivotally mounted on a support shaft 45 which is disposed at a downstream side of the separating pad 17. When the intermediate plate 7 is lowered, the releasing member 7a is abutted against a free end 43a of the support plate 43, thus lowering the separating pad 17. It is known that the support shaft 45 may be positioned on a tangential line at a contacting point (separation point) between the separating pad 17 and the sheet supply roller 10.

Alternatively, as shown in FIG. 4B, a support member 46 holding the separating pad 17 may be mounted within a guide member 47 for up-and-down movement so that the releasing member 7a of the intermediate plate 7 can be abutted against a projection 46a of the support member 46. In this alternative embodiment, the same technical effect as that of the previous embodiment can be achieved. It is known that the shifting direction of the separating pad 17 may be selected to coincide with the normal line of the separating pad 17.

Figure 5A:
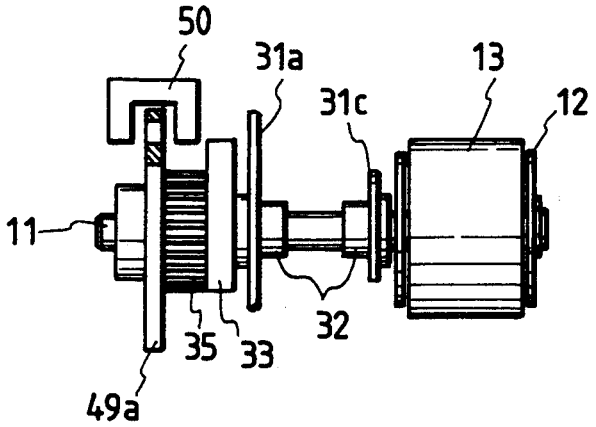
FIGS. 5A and 5B are side views showing another example of a drive control mechanism.
Figure 5B:
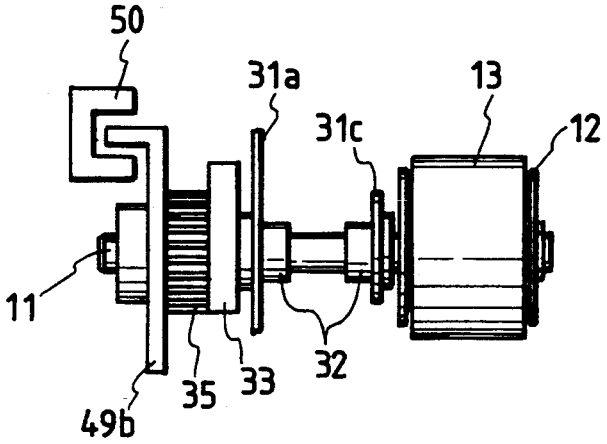

FIGS. 5A and 5B show another embodiment of the support shaft 11 for the driving system.

In the aforementioned preferred embodiment, while one revolution of the sheet supply roller 10 was controlled by using the spring clutch 40, such control may be effected by controlling the rotation of a motor (not shown) by means of a control ring 49a or 49b provided on the support shaft 11 and a photo-interrupter 50 as shown in FIGS. 5A and 5B. Further, in the aforementioned preferred embodiment, while the sheet feeding means was comprised of the drive roller 23 and the driven roller 25, in place of these rollers, the sheet feeding means may comprise a pair of register rollers for determining the timing of the feeding of the sheet.

Figure 6A:
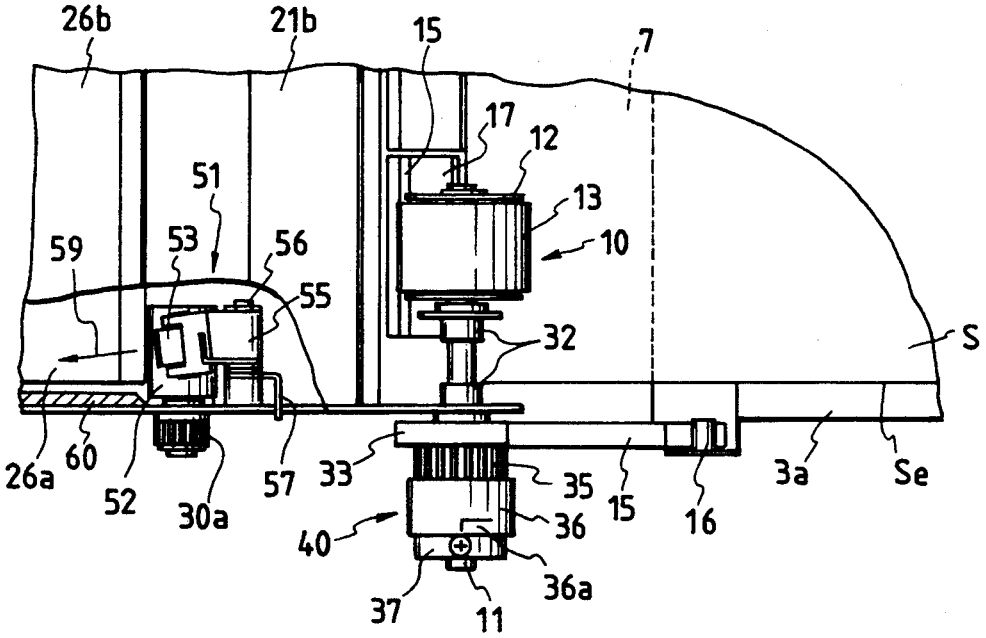
FIG. 6A is a plan view of a sheet feeding apparatus according to a third embodiment of the present invention.
Figure 6B:
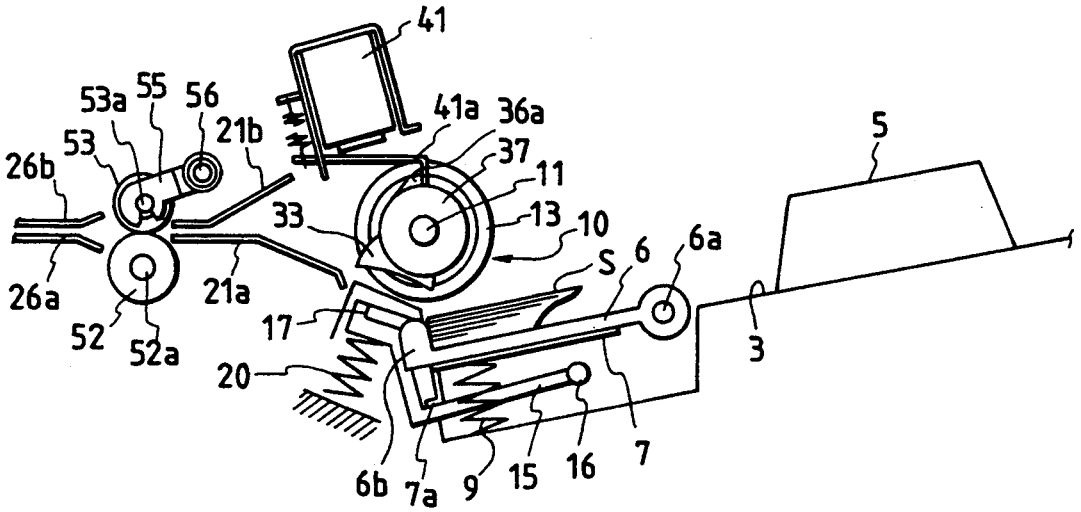
FIG. 6B is an elevational sectional view of the apparatus of FIG. 6A.

FIGS. 6A and 6B show a third embodiment of the present invention, where FIG. 6A is a partial plan view of a sheet feeding apparatus according to the third embodiment and FIG. 6B is an elevational sectional view of such apparatus.

The sheet feeding means comprises a drive roller 52 made of friction material, a driven roller 53 urged against the drive roller, and an abutment guide 60. The driven roller 53 mounted on a free end of a support member 55 is urged against the drive roller 52 by means of an elastic member 57. Further, an axis of the driven roller 53 is inclined at an angle with respect to an axis of the drive roller 52 so that the sheet S pinched by these rollers is fed in a direction shown by the arrow 59 (outward direction) to abut one lateral edge Se of the sheet S against the abutment guide 60. Thus, the sheet S is conveyed along the abutment guide 60.

FIGS. 7A to 7C show a fourth embodiment of the present invention, wherein the above-mentioned drive roller 52, driven roller 53 and support member 55 constitute a set of skew-feed rollers 51.

As shown in FIG. 7A, the skew-feed roller set 51 and the abutment member 60 may be disposed at an opposite side of the sheet supply roller 10 with respect to the center line of the sheet. Alternatively, as shown in FIG. 7B, the position of sheet supply roller 10, and the positions of the skew-feed roller set 51 and the abutment member 60 may be reversed with respect to the arrangement of FIG. 7A. Further, as shown in FIG. 7C, the positions of the skew-feed roller set 51, support shaft **6*a* and sheet supply roller 10 may be reversed with respect to the arrangement of FIG. 6**.

Figure 8A:
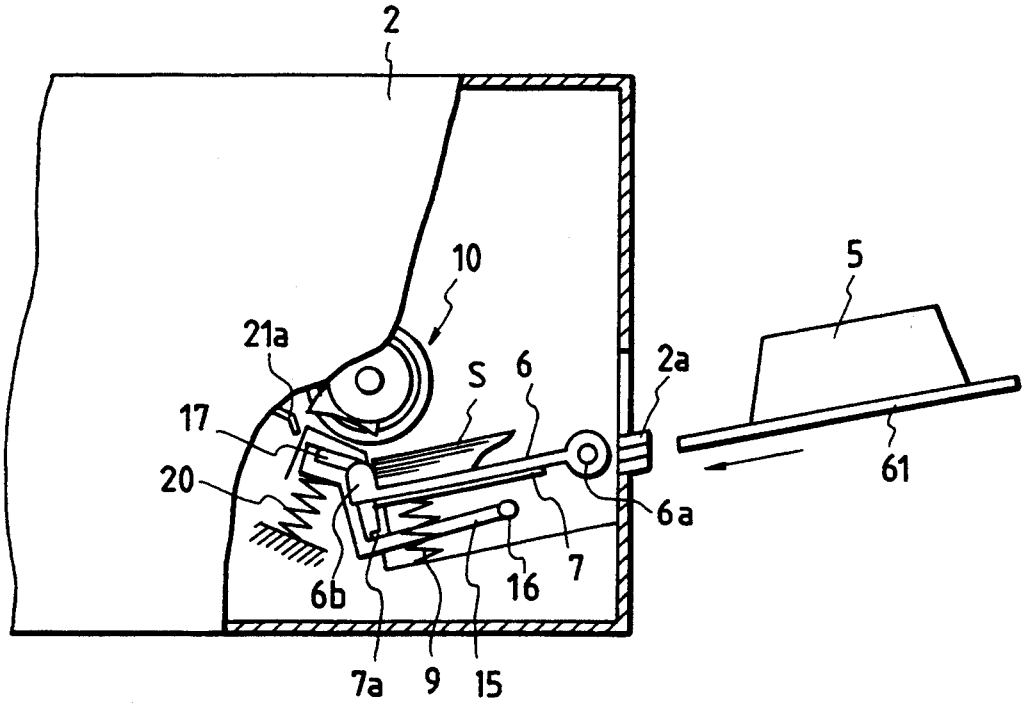
FIGS. 8A and 8B are elevational sectional views showing another example of an attachment condition of a sheet stacking support.
Figure 8B:
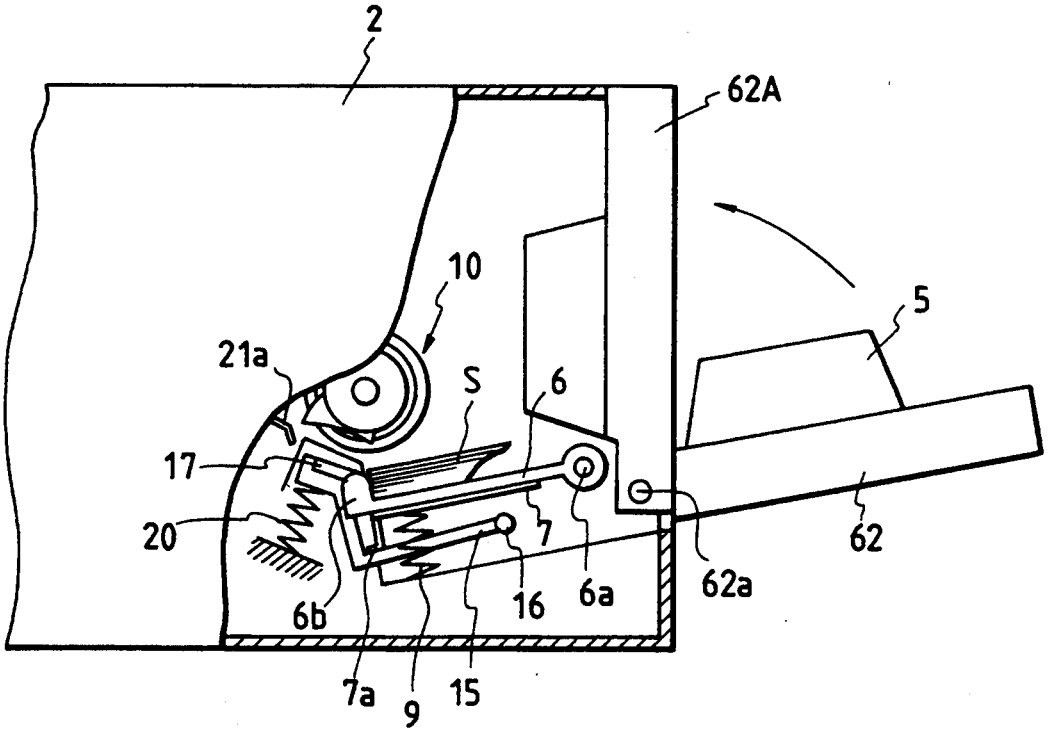

In FIG. 8A, a sheet stacking support 61 on which the sheets S are stacked may be removably mounted on an attachment portion 2a of a body frame 2 of the sheet feeding apparatus. Alternatively, as shown in FIG. 8B, a sheet stacking support 62 may be rotatably supported by a support shaft 72a so that the sheet stacking support 62 can be housed within a containing position 62A in the body frame 2.

Incidentally, in FIG. 1, if an adequate space defined by the guides **21*a*, 21*b* can be obtained, the sheet feeding speed by means of the paired feed rollers 22 may be greater than the sheet supplying speed by means of the sheet supply roller 10**.

Figure 9:
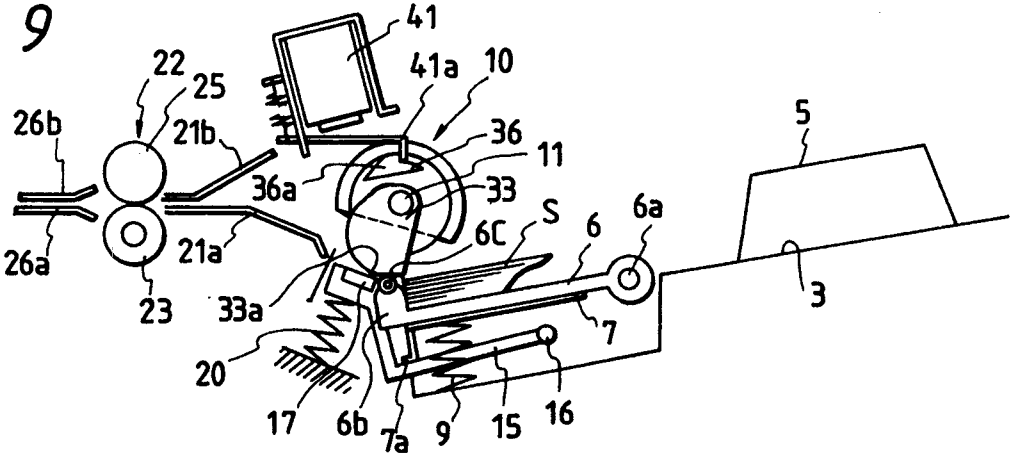
FIG. 9 is an elevational sectional view showing another example of the sheet supply roller.

Further, as shown in FIG. 9, the sheet supply roller 10 may be constituted by a semi-cylindrical roller. In this case, it is possible to surely prevent the action of the back tension by positioning a flat surface of the semi-cylindrical sheet supply roller 10 in confronting relation to the separating pad 17 during the sheet S feeding operation. As shown in FIG. 9, a roller **6*c* may be rotatably mounted on the free end 6*b* of the support member 6 to reduce the sliding resistance between the cam 33 and the support member 6**.

Figure 10:
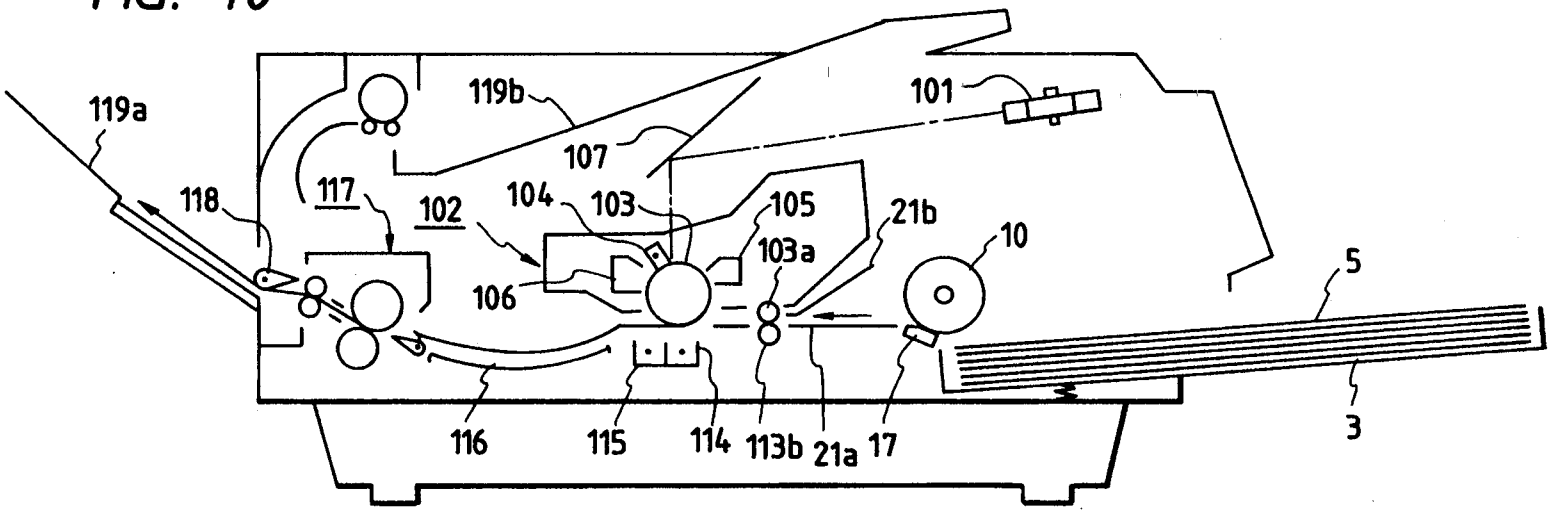
FIG. 10 is a schematic elevational sectional view of an image forming system incorporating the sheet feeding apparatus of the present invention therein.

Next, a laser beam printer incorporating the sheet feeding apparatus of the present invention therein will be explained with reference to FIG. 10.

The laser beam printer comprises a scanner unit 101 for illuminating and scanning the sheet by a laser beam in response to image information, and a process cartridge 102 including a recording means comprising a photosensitive drum 103 acting as an image bearing member, a primary charger 104 constituted by a corona discharger, a developing device 105 containing toner and a cleaner 106.

The laser beam emitted from the scanner unit 101 is directed onto the photosensitive drum 103 in the process cartridge 102 via a reflection mirror 107. The photosensitive drum 103 is previously charged by the primary charger 104. Accordingly, an electrostatic latent image is formed on the photosensitive drum by illuminating the laser beam thereon and the latent image is visualized by the developing device 105 to form a toner image.

On the other hand, the sheets S supplied from the sheet stacking support 3 by means of the sheet supply roller 10 are separated one by one by means of the separating pad 17 disposed in confronting relation to the sheet supply roller 10. The separated sheet S is guided by the upper and lower guides **21*a*, 21*b* and is sent to a pair of regist rollers 113*a*, 113*b* which are now temporarily stopped, so that the skew-feed of the sheet is corrected. Then, the sheet S is fed to a transfer station in synchrony with a leading end of the toner image formed on the photosensitive drum 103**.

A transfer charger for transferring the toner image formed on the photosensitive drum 103 onto the sheet S is designated by 114. Charges having the polarity opposite to that of the toner are given on a back surface of the sheet by the transfer charger 114, and the toner image is gradually transferred from the photosensitive drum 103 to the sheet S. After the image is transferred to the sheet by the transfer charger 114, the sheet S is separated from the photosensitive drum 103 by charging it to the polarity opposite to that of the transfer charger 114 by means of a separating charger 115. The residual toner remaining on the photosensitive drum 103 is removed by the cleaner 106 so that the photosensitive drum can be re-used for the next recording operation.

The separated sheet S is then fed to a fixing device 117 by means of a conveying means 116. The non-fixed and transferred toner image is permanently fixed onto the sheet by the fixing device 117. Thereafter, the sheet S is ejected onto an ejector tray **119*a* or 119*b* through either of sheet feeding paths selected by a flapper 118**.

I claim:

1. A sheet feeding apparatus, comprising:

sheet supporting means for supporting sheets;

rotatable sheet supply means for supplying sheets supported by said sheet supporting means;

first biasing means for generating a first bias pressure between the sheets supported by said sheet supporting means and said rotatable sheet supply means;

separating means provided independently of said sheet supporting means for separating sheets supplied by said rotatable sheet supply means one by one;

second biasing means for generating a second bias pressure between said separating means and said rotatable sheet supply means;

conveying means disposed downstream of said separating means for conveying a sheet separated by said separating means; and pressure releasing means for releasing the first and second bias pressures generated by said first and second biasing means after a sheet reaches said conveying means so that the sheet conveyed by said conveying means is not subjected to a load generated by the bias pressures.

2. A sheet feeding apparatus according to claim 1, wherein an urging area where said separating means is biased against said rotatable sheet supply means is situated downstream of an abutting area where the sheet is abutted against said rotatable sheet supply means.

3. A sheet feeding apparatus according to claim 2, wherein said separating means comprises a friction pad which can be urged against and separated from said rotatable sheet supply means and which is urged against said rotatable sheet supply means by means of said second biasing means.

4. A sheet feeding apparatus according to claim 1, said pressure releasing means comprising shifting means for shifting said sheet supporting means between a sheet supplying position where pressure is generated between the sheets and said rotatable sheet supply means, and a waiting position where the sheets are separated from said rotatable supply means, and wherein said pressure releasing means releases the urging pressure in response to a separating operation for separating said sheet supporting means from said rotatable sheet supply means.

5. A sheet feeding apparatus according to claim 4, wherein said sheet supporting means comprises a plate adapted to support the sheets thereon and shiftable between the sheet supplying position and the waiting position, and wherein said plate is biased toward the sheet supplying position by said first biasing means.

6. A sheet feeding apparatus according to claim 5, wherein said shifting means comprises a cam having a cam portion for shifting said plate from said sheet supplying position to said waiting position in opposition to a biasing force of said first biasing means and a cam portion for shifting said plate from said waiting position to said sheet supplying position.

7. A sheet feeding apparatus according to claim 6, wherein said cam is provided on a drive shaft of said rotatable sheet supply means so that said cam shifts said plate between the sheet supplying position and the waiting position once whenever said rotatable sheet supply means is rotated by one revolution.

8. A sheet feeding apparatus according to claim 7, wherein a clutch for controlling one revolution of said rotatable sheet supply means is provided on said drive shaft.

9. A sheet feeding apparatus according to claim 5, wherein said separating means comprises a friction pad which can be urged against and separated from said rotatable sheet supply means and which is urged against said rotatable sheet supply means by means of said second biasing means.

10. A sheet feeding apparatus according to claim 9, wherein said pressure releasing means comprises an engagement means for engaging said plate by said friction pad while said plate is being shifted from the sheet supplying position to the waiting position and for releasing said second bias pressure by separating said friction pad from said rotatable sheet supply means in opposition to a biasing force of said second biasing means in response to the shifting movement of said plate.

11. A sheet feeding apparatus, comprising:

sheet supporting means for supporting sheets;

rotatable sheet supply means disposed at a position offset from a center line of a width of a sheet supported by said sheet supporting means toward one end of the sheet for feeding out sheets supported by the sheet supporting means;

first biasing means for generating a first bias pressure between sheets supported by said sheet supporting means and said rotatable sheet supply means;

separating means for separating sheets supplied by said rotatable sheet supply means one by one;

second biasing means for generating a second bias pressure between said separating means and said rotatable sheet supply means;

skew-feed correction means disposed downstream of said separating means for correcting skew-feed of a sheet separated by said separating means; and pressure releasing means for releasing the first and second bias pressures generated by said first and second biasing means after a sheet reaches said skew-feed correction means so that the sheet is not subjected to a load generated by the bias pressures.

12. A sheet feeding apparatus according to claim 11, wherein said separating means is biased against said rotatable sheet supply means to separate the sheets one by one between said separating means and said rotatable sheet supply means.

13. A sheet feeding apparatus according to claim 12, wherein an urging area where said separating means is biased against said rotatable sheet supply means is situated downstream of an abutting area where the sheet is abutted against said rotatable sheet supply means.

14. A sheet feeding apparatus according to claim 13, wherein said separating means comprises a friction pad which can be urged against and separated from said rotatable sheet supply means and which is urged against said rotatable sheet supply means by means of said second biasing means.

15. A sheet feeding apparatus according to claim 12, said pressure releasing means comprising shifting means for shifting said sheet supporting means between a sheet supplying position where said first pressure is generated between the sheets and said rotatable sheet supply means and a waiting position where the sheets are separated from said rotatable supply means, and wherein said pressure releasing means releases said first pressure in response to a separating operation for separating said sheet supporting means from said rotatable sheet supply means.

16. A sheet feeding apparatus according to claim 15, wherein said sheet supporting means comprises a plate adapted to support the sheets thereon and shiftable between the sheet supplying position and the waiting position, and wherein said plate is biased toward said sheet supplying position by said first biasing means.

17. A sheet feeding apparatus according to claim 16, wherein said shifting means comprises a cam having a cam portion for shifting said plate from the sheet supplying position to the waiting position in opposition to a biasing force of said first biasing means and a cam portion for shifting said plate from the waiting position to the sheet supplying position.

18. A sheet feeding apparatus according to claim 17, wherein said cam is provided on a drive shaft of said rotatable sheet supply means so that said cam shifts said plate between the sheet supplying position and the waiting position once whenever said rotatable sheet supply means is rotated by one revolution.

19. A sheet feeding apparatus according to claim 18, wherein a clutch for controlling one revolution of said rotatable sheet supply means is provided on said drive shaft.

20. A sheet feeding apparatus according to claim 16, wherein said separating means comprises a friction pad which can be urged against and separated from said rotatable sheet supply means and which is urged against said rotatable sheet supply means by means of said second biasing means.

21. A sheet feeding apparatus according to claim 20, wherein said pressure releasing means comprises engagement means for engaging said plate by said friction pad while said plate is being shifted from the sheet supplying position to the waiting position and for releasing said second pressure by separating said friction pad from said rotatable sheet supply means in opposition to a biasing force of said second biasing means in response to the shifting movement of said plate.

22. A sheet feeding apparatus according to claim 11, wherein said skew-feed correction means comprises a pair of skew-feed rollers comprising a drive roller and a driven roller having an axis inclined with respect to an axis of said drive roller, and a guide member for guiding the sheet in a sheet feeding direction by abutting one lateral edge of the sheet skew-fed by said pair of skew-feed rollers against said guide member.

23. A sheet feeding apparatus according to claim 22, wherein said sheet supporting means comprises a pair of regulating members for regulating movement in a transverse direction of the sheets contained in said sheet supporting means, and wherein one of said regulating members which regulates a position of one lateral edge of the sheets is fixedly disposed, and the other regulating member which regulates a position of the other lateral edge of the sheets is shiftable in a transverse direction of the sheets in accordance with a width of the sheets.

24. A sheet feeding apparatus according to claim 11, wherein a drive shaft for driving said rotatable sheet supply means is supported only at one side of said sheet feeding apparatus.

25. An image forming system, comprising:

sheet supporting means for supporting a plurality of sheets;

rotatable sheet supply means for supplying sheets supported by said sheet supporting means;

first biasing means for generating a first bias pressure between sheets supported by said sheet supporting means and said rotatable sheet supply means;

separating means provided independently of said sheet supporting means for separating sheets supplied by said rotatable sheet supply means one by one;

second biasing means for generating a second bias pressure between said separating means and said rotatable sheet supply means;

conveying means disposed downstream of said separating means for conveying a sheet separated by said separating means;

pressure releasing means for releasing the first and second bias pressures generated by said first and second biasing means after a separated sheet reaches said conveying means so that the separated sheet conveyed by said conveying means is not subjected to a load generated by said first and second bias pressures; and image forming means for forming an image on the sheet separated by said separating means.

26. An image forming system according to claim 25, wherein an urging area where said separating means is urged against said rotatable sheet supply means is situated at a downstream side of an abutting area where the sheet is abutted against said rotatable sheet supply means.

27. An image forming system according to claim 25, said pressure releasing means comprising shifting means for shifting said sheet supporting means between a sheet supplying position where the pressure is generated between the sheets and said rotatable sheet supply means, and a waiting position where the sheets are separated from said rotatable supply means, and wherein said pressure releasing means releases the pressure in response to a separating operation for separating said sheet supporting means from said rotatable sheet supply means.

28. An image forming system, comprising:

sheet supporting means for supporting a plurality of sheets;

rotatable sheet supply means disposed at a position offset from a center line of a width of a sheet supported by said sheet supporting means toward one end of the sheet for feeding out the sheet supported by said sheet supporting means;

first biasing means for generating a first bias pressure between sheets supported by said sheet supporting means and said rotatable sheet supply means;

separating means for separating sheets supplied by said rotatable sheet supply means one by one;

second biasing means for generating a second bias pressure between said separating means and said rotatable sheet supply means;

skew-feed correction means disposed downstream of said separating means for correcting skew-feed of a sheet separated by said separating means;

pressure releasing means for releasing the first and second bias pressures generated by said first and second biasing means after a separated sheet reaches said skew-feed correction means, so that the separated sheet is not subjected to a load generated by the first and second bias pressures; and image forming means for forming an image on the sheet separated by said separating means.

29. An image forming system according to claim 28, wherein said separating means is urged against said rotatable sheet supply means to separate the sheets one by one between said separating means and said rotatable sheet supply means.

30. An image forming system according to claim 29, wherein an urging area where said separating means is urged against said rotatable sheet supply means is situated at a downstream side of an abutting area where the sheet is abutted against said rotatable sheet supply means.

31. An image forming system according to claim 28, said pressure releasing means comprising shifting means for shifting said sheet supporting means between a sheet supplying position where pressure is generated between the sheets and said rotatable sheet supply means and a waiting position where the sheets are separated from said rotatable sheet supply means, and wherein said pressure releasing means releases the pressure in response to a separating operation for separating said sheet supporting means from said rotatable sheet supply means.

32. An image forming system according to claim 28, wherein said skew-feed correction means comprises a pair of skew-feed rollers comprising a drive roller and a driven roller having an axis inclined with respect to an axis of said drive roller, and a guide member for guiding the sheet in a sheet feeding direction by abutting one lateral edge of the sheet skew-fed by said pair of skew-feed rollers against said guide member.

33. An image forming system according to claim 28, wherein a drive shaft for driving said rotatable sheet supply means is supported only at one side of the sheet feeding apparatus.

34. A sheet feeding apparatus, comprising:

sheet supporting means for supporting sheets;

sheet supply means for supplying sheets supported by said sheet supporting means, the sheets supported by said sheet supporting means being pressed between said sheet supply means and said sheet supporting means by a predetermined supplying pressure;

separating means for separating sheets supplied from said sheet supporting means one by one by a predetermined separating pressure;

conveying means disposed downstream of said separating means for conveying a sheet separated by said separating means; and pressure releasing means for releasing the supplying pressure after a sheet is separated by said separating means, and for releasing the separating pressure after releasing the supplying pressure so that a sheet conveyed by said conveying means is not subjected to a load generated by the supplying pressure and separating pressure after the sheet reaches said conveying means.

35. A sheet feeding apparatus according to claim 34, further comprising first biasing means for biasing the sheets supported on said sheet supporting means toward said sheet supply means, wherein said pressure releasing means separates the sheets supported on said sheet supporting means from said sheet supply means against a biasing force of said first biasing means.

36. A sheet feeding apparatus according to claim 34, wherein said separating means is a friction pad which is biased to said sheet supply means by a second biasing means, and said pressure releasing means separates said friction pad from said sheet supply means against a biasing force of said second biasing means.

37. A sheet feeding apparatus, comprising:

sheet supporting means for supporting sheets;

sheet supply means for supplying sheets supported by said sheet supporting means when said sheet supply means rotates, the sheets supported by said sheet supporting means being pressed between said sheet supply means and said sheet supporting means by a predetermined supplying pressure;

separating means for separating sheets supplied from said sheet supporting means one by one by a predetermined separating pressure; and pressure releasing means for releasing the supplying pressure and then releasing the separating pressure, said pressure releasing means operating for each rotation of said sheet supply means.

38. A sheet feeding apparatus according to claim 37, further comprising first biasing means for biasing said sheets supported on said sheet supporting means toward said sheet supply means, and said pressure releasing means separates the sheets supported on said sheet supporting means from said sheet supply means against the biasing force of said first biasing means.

39. A sheet feeding apparatus according to claim 37, wherein said separating means is a friction pad which is biased to said sheet supply means by second biasing means, and said pressure releasing means separates said friction pad from said sheet supply means against the biasing force by said second biasing means.

40. An image forming apparatus, comprising:

sheet supporting means for supporting sheets;

sheet supply means for supplying sheets supported by said sheet supporting means, the sheets supported by said sheet supporting means being pressed between said sheet supply means and said sheet supporting means by a predetermined supplying pressure;

separating means for separating sheets supplied from said sheet supporting means one by one by a predetermined separating pressure;

conveying means disposed downstream of said separating means for conveying a sheet separated by said separating means;

pressure releasing means for releasing the supplying pressure after a sheet is separated by said separating means, and for releasing the separating pressure after releasing the supplying pressure so that a sheet conveyed by said conveying means is not subjected to a load generated by the supplying pressure and separating pressure after the sheet reaches said conveying means; and image forming means for forming an image on the sheet separated by said separating means.

41. An image forming apparatus, comprising:

sheet supporting means for supporting sheets;

sheet supply means for supplying sheets supported by said sheet supporting means when said sheet supply means rotates, the sheets supported by said sheet supporting means being pressed between said sheet supply means and said sheet supporting means by a predetermined supplying pressure;

separating means for separating sheets supplied from said sheet supporting means one by one by a predetermined separating pressure;

pressure releasing means for releasing the supplying pressure and then releasing the separating pressure, said pressure releasing means operating for each rotation of said sheet supply means; and image forming means for forming an image on the sheet separated by said separating means.

42. A sheet feeding apparatus, comprising:

sheet supporting means for supporting sheets, said sheet supporting means being shiftable between a sheet supplying position and a waiting position;

rotatable sheet supply means for supplying sheets supported on said sheet supporting means;

separating means for separating sheets supplied by said rotatable sheet supply means one by one, said separating means being shiftable between a separating position and a non-separating position;

a cam member for shifting said sheet supporting means from the waiting position to the sheet supplying position in response to rotation of said rotatable sheet supply means; and shifting means for shifting said separating means from the separating position to the non-separating position in response to a shifting operation of said sheet supporting means by said cam member.

43. A sheet feeding apparatus according to claim 42, wherein said cam member is provided on a drive shaft of said sheet supplying means so that said cam member shifts said sheet supporting means between the sheet supplying position and the waiting position when said rotatable sheet supply means is rotated by one revolution.

* * * * *

UNITED STATES PATENT AND TRADEMARK OFFICE

CERTIFICATE OF CORRECTION

PATENT NO. : 5,386,983

DATED : 2/7/95

INVENTOR(S) : Masao Ando

It is certified that error appears in the above-indentified patent and that said Letters Patent is hereby corrected as shown below:

Title page, item [56], under Foreign Patent Documents line 9, "2138041 5/1990 Japan" should read --2-138041 5/1990 japan--.

Column 8, line 37, "an" should be deleted.
Column 10, line 17, "claim 12," should read --claim 11, --.
Column 11, line 57, "the" should be deleted.

Signed and Sealed this

Ninth Day of May, 1995

*Attest:*

*Attesting Officer*

BRUCE LEHMAN

*Commissioner of Patents and Trademarks*